US008221510B2

(12) United States Patent
Bruso

(10) Patent No.: US 8,221,510 B2
(45) Date of Patent: Jul. 17, 2012

(54) METHOD AND APPARATUS FOR REFINING COAL

(76) Inventor: Bruce L. Bruso, Hegins, PA (US)

( * ) Notice: Subject to any disclaimer, the term of this patent is extended or adjusted under 35 U.S.C. 154(b) by 383 days.

(21) Appl. No.: 12/460,181

(22) Filed: Jul. 14, 2009

(65) Prior Publication Data

US 2010/0011658 A1 Jan. 21, 2010

Related U.S. Application Data

(60) Provisional application No. 61/134,991, filed on Jul. 16, 2008.

(51) Int. Cl.
*C10L 9/02* (2006.01)
*C10L 9/00* (2006.01)

(52) U.S. Cl. ..... 44/624; 201/17; 423/517

(58) Field of Classification Search ..... 44/625, 44/280, 624; 201/17; 423/517
See application file for complete search history.

(56) References Cited

U.S. PATENT DOCUMENTS

| | | | | | |
|---|---|---|---|---|---|
| 3,870,237 | A | | 3/1975 | Aldrich et al. | 241/1 |
| 3,917,465 | A | | 11/1975 | Meyers | 44/2 |
| 3,926,575 | A | | 12/1975 | Meyers | 44/1 R |
| 3,960,513 | A | * | 6/1976 | Agarwal et al. | 44/625 |
| 4,081,250 | A | | 3/1978 | Hsu et al. | 44/1 R |
| 4,152,120 | A | | 5/1979 | Zavitsanos et al. | 44/1 R |
| 4,159,242 | A | | 6/1979 | Walker | 209/44 |
| 4,169,710 | A | | 10/1979 | Jensen | 44/1 SR |
| 4,302,430 | A | | 11/1981 | Weber et al. | 423/234 |
| 4,325,819 | A | | 4/1982 | Altizer | 209/10 |
| 4,328,002 | A | | 5/1982 | Bender | 44/1 SR |
| 4,462,807 | A | | 7/1984 | Jayasinghe et al. | 44/1 R |
| 4,497,636 | A | | 2/1985 | Aida et al. | 44/15 R |
| 4,526,585 | A | * | 7/1985 | Burgess et al. | 44/280 |
| 4,560,390 | A | | 12/1985 | Bender | 44/15 R |
| 4,582,512 | A | | 4/1986 | Smit et al. | 44/51 |
| 5,192,338 | A | | 3/1993 | Waugh et al. | 44/627 |
| 5,505,746 | A | | 4/1996 | Chriswell et al. | 44/624 |
| 6,156,281 | A | | 12/2000 | Akers et al. | 423/107 |
| 6,325,001 | B1 | | 12/2001 | Sheldon et al. | 110/342 |
| 6,544,425 | B2 | | 4/2003 | Miller | 210/710 |
| 2008/0149542 | A1 | | 6/2008 | Bjornson et al. | 210/137 |

OTHER PUBLICATIONS

Written Opinion of the International Searching Authority and International Search Report, PCT/US200904102, Sep. 29, 2009.

J.W. Hamersma, et al., "*Chemical Removal of Pyritic Sulfur from Coal*", pp. 1-14, The Systems Group, One Space Park, Redondo Beach, CA 90278, USA, 1971. K. Komnitsas, et al., "*Sulfur Removal From Coal Benefication Wastes*", Department of Mining and Metallurgical Engineering, National Technical University of Athens Zografos Campus, 157-73, Greece. Paper present at the 7th CEST Conference, Sep. 2001, Syros, Greece, pp. 1-8.

* cited by examiner

*Primary Examiner* — James Goloboy
*Assistant Examiner* — Chantel Graham
(74) *Attorney, Agent, or Firm* — Drinker Biddle & Reath, LLP

(57) ABSTRACT

A method of processing coal to remove sulfur and other contaminants by mixing coal in a solution of aqueous ammonia having a selected concentration range (preferred range of 3%-5%) of ammonia to water in a reaction vessel. The mixing causes the solution to be brought into contact with the surfaces and pores of the coal. The process is monitored to detect when the concentration of aqueous ammonia in the reaction vessel has fallen below the selected range, and aqueous ammonia with an ammonia concentration in or above the selected range is fed into the reaction vessel to return the solution to within the selected range. The cleaned coal may be rinsed and dried, or dried without rinsing to form an ammonia coating on the coal surfaces and pores. Several plant layouts to practice the method are described.

9 Claims, 3 Drawing Sheets

METHOD AND APPARATUS FOR REFINING COAL

CROSS REFERENCE TO RELATED APPLICATION

This application claims priority from U.S. Provisional Application No. 61/134,991 filed on Jul. 16, 2008, the content of which is incorporated by reference herein.

FIELD OF THE INVENTION

This invention is related to the general field of refining coal, and to the more specific field of processing coal to remove contaminants that may produce environmental pollutants in the combustion products of coal.

BACKGROUND OF THE INVENTION

This invention is applicable to refining various types of coal; anthracite, bituminous, and lignite. Its primary application will be with coals burned for industrial purposes. Depending upon the source, these coals contain various contaminants that may produce environmental pollutants in the combustion gas or the ash residue. Various methods of washing, mechanical separation and chemical reaction have been and are being used to reduce these contaminants before the coal is burned.

Sulfur is a significant contaminant of particular concern for industrial coal burning plants. Coals containing a high sulfur content can release a significant amount of sulfur oxides in combustion gases. The most common form of sulfur oxide in combustion gas is sulfur dioxide ($SO_2$), and it is of particular environmental concern. Sulfur dioxide reacts with oxygen, usually in the pre sence of a catalyst such as nitrogen dioxide ($NO_2$), to form sulfur trioxide ($SO_3$), which then reacts with water molecules in the atmosphere to form sulfuric acid ($H_2SO_4$) that is returned to the Earth as acid rain. Consequently, environmental concerns about these pollutants in coal combustion gas have produced government regulations limiting the emissions of sulfur oxides (SOx) and nitrogen oxides (NOx). Nitrogen oxide emissions from coal combustion can be reduced by burner technologies, such as fluidized bed combustion. For sulfur oxide reduction, there are flue gas desulfurization systems for scrubbing the sulfur oxides from coal combustion gases in the flue stacks of modern coal-fired electrical generation plants, but it is generally more effective to reduce the sulfur content of any high sulfur coal prior to its combustion.

Chemical analyses of coal generally report the sulfur content in three categories, sulfate sulfur, pyritic sulfur and organic sulfur, which combine to make the total sulfur content of a coal sample. Most analysis protocols measure pyritic sulfur and organic sulfur, along with total sulfur content. The difference between the pyritic and organic contribution and the total sulfur is then attributed to sulfates. The type of sulfate may be a calcium sulfate, such as gypsum, or ferrous sulfates produced by weathering of exposed coal. Regardless of type, separating sulfates from coal is relatively easy, since sulfates can be can be dissolved in diluted acid solutions or other solvents.

Pyritic sulfate is primarily iron disulfide ($FeS_2$), a crystalline mineral known as pyrite. Pyrite frequently occurs in veins and beds near to or interwoven through coal seams. Pyrite is not soluble in water or weak acid solution. However, pyritic sulfates have a specific gravity 3 to 4 times greater than the coal. Thus, much of the pyritic form of sulfur can be separated from coal by traditional methods of gravity concentration, such as the dense medium separators or centrifuges commonly used in coal washing.

Organic sulfur is part of the coal itself, linked by chemical bonds. Organic sulfur has traditionally been difficult to remove because it cannot be separated from the coal without breaking the chemical bond. Oxidation reactions can be used to break the bonds and free the sulfur in other forms for removal from the coal matrix.

Consequently, in view of these different forms of sulfur content, the prior art of coal refining for sulfur reduction includes a wide range of processes, from simple washing in a solvent solution or washing in combination with dense media separation and/or froth flotation to dissolve most of the sulfate and separate much of the pyritic sulfur from the coal, to the use of chemical oxidants, oxidative enzymes and microbial desulfurization methods.

Chemical reagents have also been suggested for more aggressive reduction of pyritic sulfur. For example, the Meyers Process described in the article *Chemical Removal of Prytic Sulfur from Coal*, and in U.S. Pat. Nos. 3,926,575 and 3,917,465 (Meyers) is directed to the removal of pyritic sulfur by chemical reaction using ferric chloride or ferric sulfate as an oxidizing agent. It acknowledges that pyrite is insoluble in water, and that the acids commonly used to dissolve most inorganic salts (and sulfates) will not dissolve pyrite. Therefore, an oxidizing agent is used in the Meyers Process to convert the pyrite to sulfates or elemental sulfur, which are soluble in a diluted acid solution. The Meyers Process is based upon the postulate that ferric chloride and ferric sulfate are more selective to pyrite oxidation than to coal oxidation, with ferric sulfate being the preferred agent. Using reaction temperatures of about 100° C., Meyers reports from 40 to 70% removal of pyritic sulfur from bituminous coal by using ferric sulfate or ferric chloride as oxidation agents, followed by a neutralization wash in toluene.

There have also been chemical processes to reduce organic sulfur along with the pyrite. A process of coal desulphurization described by Hsu, et al in U.S. Pat. No. 4,081,250 uses a chlorine gas bubbled through a slurry of moist coal in a chlorinated solvent to wash away pyritic sulfur and to convert organic sulfur into soluble sulfates. The chlorinated coal is then separated, hydrolyzed and de-chlorinated by heating at 500° C.

Other processes eliminate a need for external heat by inducing an exothermic oxidation reaction in the coal over a brief period. U.S. Pat. No. 4,328,002 (Bender) describes a process of this type in which the coal is pretreated with a dilute aqueous suspension of an oxidizing agent, washed with water, and then sprayed with or immersed in a concentrated solution of the oxidizing agent for 1 to 2 minutes, during which time the exothermal reaction peeks. A later patent to Bender, U.S. Pat. No. 4,560,390, describes, however, that the exposure time to the oxidizing agent solution can be reduced to as short as 22-30 seconds exposure time when the reaction takes place inside of a hydrocyclone or a dense media classifier.

In view of these varied prior methods of treatment, an object of this invention is to find an effective and cost efficient coal refining process that can be practiced on an industrial scale to substantially reduce total sulfur content, including organic sulfur, from coal. The concurrent reduction of other coal contaminants and the increase in BTU output in the processed are welcome additional effects.

BRIEF SUMMARY OF THE INVENTION

Basic Process

The coal refining process of this application uses ammonium hydroxide ($NH_4OH$), more commonly known as aqueous ammonia, as a solvent and as an oxidizing agent for reducing sulfur contaminant in coal. While ammonia has been suggested as a component of an oxidation reagent, as in the Bender patents described above, the process of this invention is carried out with more dilute concentrations of aqueous ammonia to eliminate the strong exothermal reactions that are described in the Bender patents. Cost efficiencies and environmental protection in this process are achieved by maintaining the selected $NH_4OH$ concentration while recycling and reusing the treatment solution. In addition, process controllers can be used to automate the recycling and maintenance of the selected concentration.

There is technically not an isolatable compound of ammonium hydroxide, but the $NH_4OH$ representation gives an accurate description of how an ammonia/water solution behaves, and so is commonly employed. When added to water, ammonia deprotonates some small fraction of the water to give ammonium ions ($NH_4$+) and hydroxide ions (OH—). Consequently sensors measuring the aqueous ammonia concentration in the process described herein may do so by measuring the $NH_4$+ ion concentration in the solution In its general terms, the invention includes a method of processing coal to remove contaminants, comprising the steps of: (a) providing a solution of aqueous ammonia in a selected concentration range of ammonia in a reaction vessel; (b) adding coal into the reaction vessel; (c) agitating the coal inside the reaction vessel to mix the coal and solution to cause the solution to be brought into contact with the surfaces and pores of the coal; (d) discharging the processed coal from the vessel; (e) monitoring the process to detect when the concentration of aqueous ammonia in the reaction vessel has fallen below the selected range; and (d) feeding aqueous ammonia with an ammonia concentration in or above the selected range to the reaction vessel to return the solution to within the selected range.

The aqueous ammonia used for this process can be prepared by mixing anhydrous ammonia ($NH_3$) into water. To avoid EPA, OSHA and other regulatory reporting and handling requirements, the concentration range should be 19% by weight of NH3 or less. In practice, the process is effective when maintained in a selected range below 10%, and the preferred embodiment of the process is a concentration maintained between about 3% to 5% by weight of anhydrous ammonia to water.

The aqueous ammonia is applied to the coal inside of a reaction vessel (or in serial reaction vessels in a sequential flow process). In one embodiment described herein, the reaction vessel is a mixer/separator vessel, such as a rotary drum scrubber having paddles to lift the coal out of the solution and drop it back into the solution as the drum rotates. This physical mixing function helps break the pyritic sulfur from adhesion to the coal particles so that the denser pyrite can be screened out of the solution at the bottom of the drum. The rotary agitation also brings the ammonia solution into contact with all of the coal, including the pores in the exposed surfaces, and allows exposure to air as the coal is lifted and dropped, so that the ammonia is able to oxidize organic sulfur into sulfates that will dissolve into the solution.

As alternative equipment embodiments, the agitating and mixing can be done in the reaction vessel without concurrent separation of pyrites. The reaction vessel need not have the ability to clarify the lighter coal from the heavier pyrite and other dense media if a slurry output of the vessel is sent to a separate specific gravity clarifier device.

As another equipment alternative, a course material screw washer (or screw washers in series) can be used to provide the requisite agitation, aeration and exposure time in the ammonia solution, while floating off fine coal particles from the coarser size coal and the heavier pyrite. A dense material separation process can then be used to remove pyrite flakes from the coarser coal following the screw washers. These and other alternative apparatus and plant layouts are described in the drawings and detailed description.

Ammonia Recovery and Re-Use

Another aspect of the invention includes the recovery and recycling of the ammonia solution. Dirty ammonia solution is drained from the reaction vessel, either as interval discharge or a continuous metered flow. A useful burden of coal fines can be recovered from the dirty solution by known particle separators, such as a scavenger bend screen or a screen bowl centrifuge. The solution is sampled by a sensor or other monitoring device to detect the ammonia concentration, either before or downstream of the coal fine separator. Following recovery of the coal fines, the solution is recycled to the reaction vessel(s), and if the ammonia concentration has fallen below the selected range, aqueous ammonia with an ammonia concentration in or above the selected range can be added to the reaction vessel to return the solution to within the selected range.

Water Recovery

The processed coal, including the recoverable fines, will be in dense slurry form until it is de-waters and dried. The slurry may also be rinsed with de-mineralized water before the de-watering and drying. The water pressed from the slurry, including any rinse water, is directed through another separator to remove the insoluble particles such as remaining coal, pyrite or other minerals. The water can be recycled to the reaction vessel or to a holding tank with the recycled solution. The water carrying off the separated insoluble particle is directed to a flocculation tank.

The process will also discharge ammonia solution from the main clarifier to carry the pyrite distillate. The distillate is also routed to the flocculation tank where the pyrite and other dense particle matter is flocculated out of the distillate. The water recovered from the flocculation tank can be de-mineralized and reused in the process.

This process is environmentally sound in that the ammonia is largely recovered and reused without venting to the atmosphere or being discharged as dirty waste water. In the preferred plant automation, programmable controls carry out the reclamation and remixing of process solution and raw materials while maintaining the NH4 ion concentration in the desired range at the reactor vessel.

Plant Layouts.

A variety of plant layouts can be employed to practice the above method. Most large scale plants will be fixed sites, but an embodiments is described where the plant is largely contained in a mobile rig that can be connected to external ammonia and water feed lines, flocculation tanks and the like to be moved around to waste coal piles or lagoons, The plants can also be run under the automation of process logic controllers or programmable general computer to control the monitoring of the ammonia level within the selected concentration range and the addition of new solution to bring it into range. The automation may also include a combustion gas test device to sample batches or interval and confirm compliance with reduction standards.

Increase in BTU Potential

Certain auxiliary beneficial changes are observed in the coal refined by the above methods. As described above, the processed coal can be rinsed and then dewatered and dried; or, alternatively, dried without rinsing to leave an aqueous ammonia coating on the coal surface. Both processes result in an increase in the heat output potential over the unwashed coal. Although the exact mechanism for the heat increase has not been investigated, it likely results in part from the ammonia solution removing non-combustible or low heat materials from the pores of the coal, resulting in an increase of surface area in which combustion can occur and in part from the residual ammonia coating on the coal surface and in the pores reducing the tnednecy of the coal to re-absorb moisture. If this is the two-part mechanism for the BTU increase, it would explain the observation that leaving a coating of ammonia on the coal surface seems to produce the larger BTU increase, sometimes in the range of 20% to 40% increase in BTUs. The pore-cleaning mechanism also explains the observation that coke buttons made from steam grade coal that has been treated by this method display an increase in the free swelling index sufficient to meet metallurgical coal specifications.

Reduction of Alkaline Oxides

A second benefit of leaving a coating of ammonia on the coal surface is the reduction of alkaline oxides formed during combustion. Analysis of the coal ash with a residual ammonia coating from the cleaning process shows reduction in sulfur trioxide, silicon dioxide, and other alkaline oxides compared to treated coal that has been rinsed clean.

Increase Efficiency of Flue Scrubbers

The residual ammonia coating from the cleaning process may also provide a source of ammonia in the flue gas to assist the NO2 air scrubbers. Ammonia is sometimes added to stack gases to reduce the nitrogen oxide content of the gases by conversion to nitrogen and water (the DeNOx process). When present in gas samples, ammonia will readily react with other components such as sulfur dioxide in the sample to form ammonium salts. This salt is relatively low-boiling, so it is present as a gas at the higher temperatures in the stack. The residual ammonia on the dried coal resulting from this process may assist the air scrubbers by providing additional ammonia in the stack gas.

Reduction of Other Contaminants

In addition to reducing sulfur content, the aqueous ammonia solution also dissolves and/or ionizes other contaminants for removal from the coal. Of these other contaminants, the more significant are chlorine, mercury and arsenic. Many coal seams have high chlorine contamination from the evaporated brine of the ancient salt marshes that produced the vegetation from which the coal was created. Chlorine is soluble in the ammonia wash solution. Other reduced contaminants include selenium, carbon based pollutants and oxidation compounds. These and other aspects of the refining process, plant layouts and coal improvement will be apparent in the description of the preferred embodiments that follows.

DETAILED DESCRIPTION OF THE PROCESS AND PLANT SHOWN IN THE DRAWINGS

Figure 1:
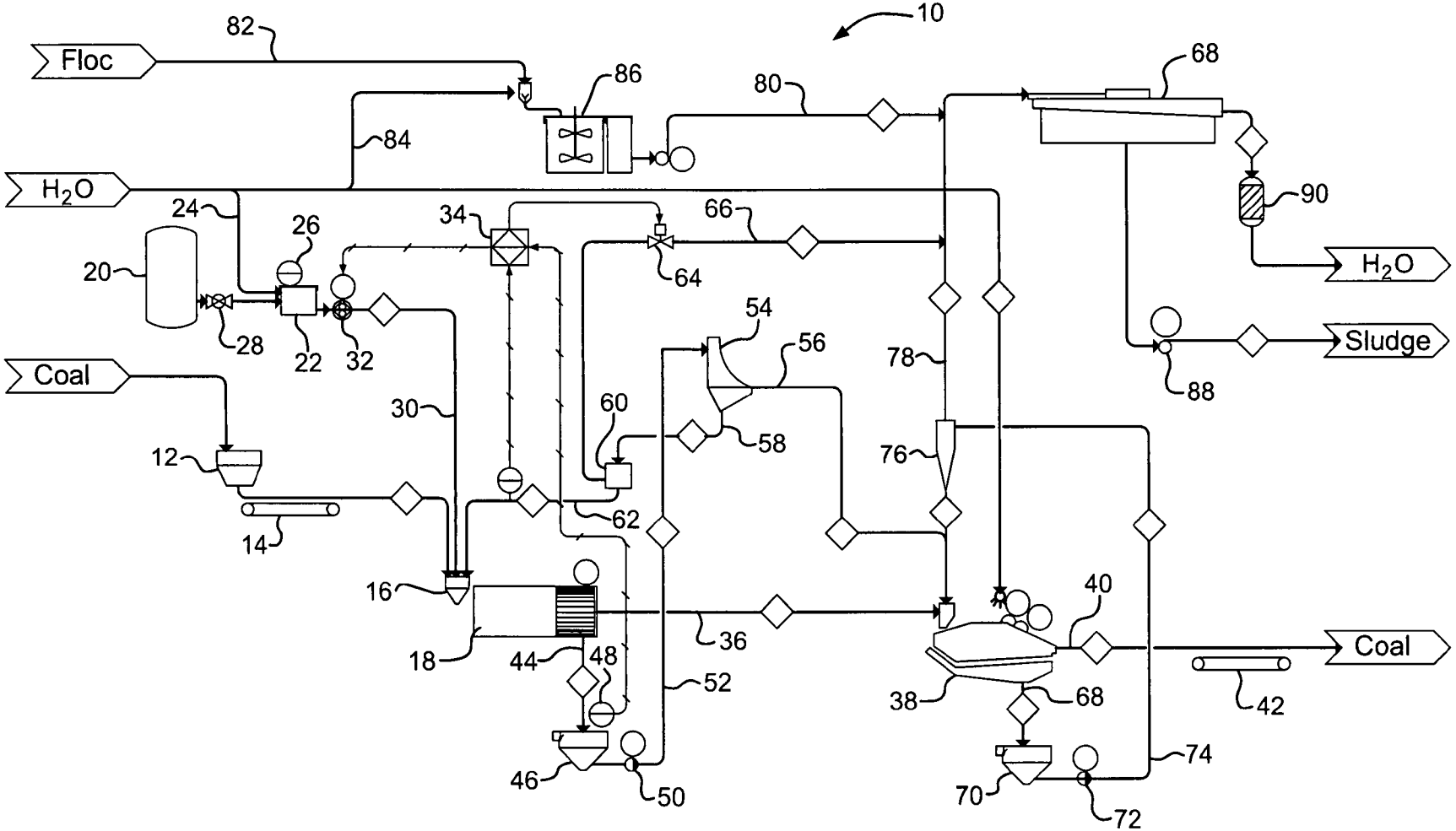
FIG. 1 is a flow sheet diagram of a coal refining plant using the invention.

The diagram in FIG. 1 depicts the layout of a coal refining plant (10) that can be used to conduct the coal refining process of this invention. Referring to FIG. 1, the path of a batch of coal begins at the left side arrow designated "COAL", showing that the coal is dumped into a feed hopper (12). The coal can be pre-washed before being placed in the feed hopper. If the coal to be processed is waste coal, such as from a gob bank or lagoon, it may contain an excessive amount of root and plant material, and a heavy sulfate coating from long weathering. This wood and plant material can be floated and screened out in a pre-wash prior to the waste coal being placed into the feed hopper. If a prewash is used, the water in the prewash is preferably de-mineralized with a commercial water softener. Caustic soda may be added to the de-mineralized water to dissolve the sulfate coating and other soluble material in the pre-wash. The wet coal is then drained before being dumped into the feed hopper (12).

The coal is conveyed from the hopper (12) by a conveyer chute (14) or belt to the input port (16) of a reaction vessel (18). The reaction vessel (18) in this embodiment is a combined reaction and separation chamber, such as the rotary drum scrubbing chamber described in U.S. Pat. No. 4,159,242 or an updated design of such rotary drum scrubber. The rotary drum scrubber is used mix the coal in the aqueous ammonia solution to remove soluble contaminants into solution, oxidize the organic sulfur to a soluble form, and separate pyrite and other higher specific gravity particles from the coal matrix. A device of this type is a drum scrubber manufactured by McLanahan Corporation, with adjustable lifter shelves to give aggressive tumbling of the coal matrix and thorough mixing of the ammonia solution throughout the coal. It should be understood that in a large scale plant, multiple reaction vessels could be staged in parallel, with the aqueous ammonia supply and recycle elements serving all of the vessels.

The reagent is an ammonium hydroxide ($NH_4OH$) solution, also referred to herein as aqueous ammonia, that is used as a solvent and as an oxidizing agent in the coal refining solution. Other solvent and oxidizing agents may be included in the reagent solution; however, an effective solution is obtained with a selected concentration range below 10% of aqueous ammonia The preferred concentration range for the aqueous ammonia is 3% to 5% ammonia to water.

To produce a solution in this range, the aqueous ammonia is originally produced by metering anhydrous ammonia ($NH_3$) from a bulk storage tank (20) into a bubbling tank (22) which also receives de-mineralized water (via water line 24) sufficient to create an aqueous ammonia solution with a dilution ratio at the high end of the preferred concentration range (i.e., at or near 5% in the bubble tank to maintain a 3% to 5% range in the reaction vessel). A sensor (26) can be used to measure the aqueous ammonia concentration by sensing the concentration in the bubble tank, and valve controls (28) used to adjust the metering of water and $NH_3$ into the bubble tank accordingly. Alternatively, feed from a tank holding a higher concentration aqueous ammonia solution (i.e., 19% to avoid reporting and handling requirements) could be used to mix with de-mineralized water to create the preferred concentration.

Fresh aqueous ammonia solution from the bubbling tank (22) is routed to the reaction vessel (via line 30) by a metering pump (32) controlled by a process controller (34). As will be described further below, the process controller receives an indication of the volume of recycled solution available to be reused in the reaction vessel, and an indication of $NH_4$ concentration in the available returning solution from one or more sensors. The controller can add fresh solution from the bubbling tank to replace liquid volume lost in the coal slurry and insoluble pyrite distillate Moreover, when the concentration of aqueous ammonia drops below a target range (i.e., below 3%), the controller can divert a portion of the recycled solution to a waste water flocculation tank and replenish the reaction vessel with a metered volume of fresh solution from the bubbling tank to bring the concentration in the reaction vessel back into the desired range.

The rotary drum scrubber reaction vessel (18) mixes the aqueous ammonia solution thoroughly into the coal. The coal particles are repeatedly lifted from the solution and dropped back into it by lifter shelves inside the drum. This aggressive mechanical mixing fragments the lumps and agglomerates of coal and allows the solution to be brought into close and repeated contact with the surfaces and pores of the coal. In addition to oxidizing organic sulfur from the coal, the solvent properties of the aqueous ammonia flush and dissolve dirt and other low combustion material from the pores. The lifting action of the paddles also exposes the coal to air in the drum for heat dissipation and to provide oxygen supply for the oxidation process. When the batch reaction is completed, the dirty solution can be allowed to drain from the drum and recycled for reuse as described hereafter.

Duration time in the reaction vessel drum can be set based upon estimates made using prior chemical analysis of a sample of the coal. The $NH_4OH$ acts as a solvent for residual sulfate and as a surfactant to free pyrite particles adhering to the coal, so that the denser pyrite can be separated from the lighter coal by gravity and screening. It also acts as an oxidizing agent for organic sulfur. The 3-5% concentration of the $NH_4OH$ is not enough to cause a sharp temperature rise by exothermic oxidation, and the small amount of reaction heat is dissipated so that no auxiliary cooling or short duration of the coal in solution is required in the reaction vessel. Duration in the vessel may typically be 3-5 minutes to assure thorough oxidation of the organic sulfur and separation of the pyrite sulfur. A higher concentration range of $NH_4OH$ could reduce the mixing duration time in the drum, but the 3-5% concentration is currently preferred as a good optimization.

When the duration time ends, the vessel is drained and the coal is discharged from the vessel as a slurry (via line 36) to a rinse and dewatering station, which can be a conventional screen dewaterer that has nozzles to provide a clean rinse of de-ionized water if desired to wash the residual aqueous ammonium solution. However, the clean water rinse may be purposely skipped, such that the coal passes from the dewatering screen (via line 40) onto a conveyor drier to evaporate the water and leave an ammonia coating over the coal surfaces. As described previously, the residual ammonia in the coating seems to increase the BTU output of the coal, and at the same time reduce the alkaline oxides formed during coal combustion. The residual ammonia coating from the cleaning process may also provide a source of beneficial ammonia in the flue gas to assist NO2 air scrubbers. Ammonia is sometimes added to flue gases to reduce the nitrogen oxide content of the gases by conversion to nitrogen and water (the DeNOx process). When present in gas samples, ammonia will readily react with other components such as sulfur dioxide in the sample to form ammonium salts. This salt is relatively low-boiling, so it is present as a gas at the temperatures in the flue stack. The residual ammonia on the dried coal resulting from this process may also add ammonia to the flue gas and assist the air scrubbers In a similar manner.

The dirty reagent solution that was drained from the reaction vessel (18) passes (via drain line 44) into a sump tank (46). The concentration of $NH_4$+ in the solution at the sump tank may be measured by a sensor (48), which sends a signal indication concentration to the process controller (34), which may be a PLC controller or a general purpose computer running a process control program.

The dirty solution in the sump tank (46) will carry a recoverable burden of fine coal. A pump (50) directs flow of the dirty solution out of the sump tank (via line 52) to fine particle separator such as a scavenger bend screen (54) to recover usable coal fines. The fines are then directed (via line 56) from the separator (54) to the coal rinse and dewatering screen (38 and mixed with the bulk of the coal to be dewatered.

The aqueous ammonia solution from the scavenger bend screen (via line 58, is collected in a recycling tank (60). When the next batch of coal is ready to be fed into the reaction vessel, the process controller determines whether the solution available in the recycling tank is sufficient, and if there is not enough in the recycling tank, the controller activates the pump (32) to deliver the amount of fresh aqueous ammonia solution from the bubbling tank (22) needed to mix with the recycled solution in the reaction vessel. The solution from the recycling tank (60) is recycled (via line 62) to the reaction vessel to be used on the next batch of coal.

If the level of $NH_4$+ in the recycled solution becomes too low, as may happen after repeated cycles, the process controller (34) may open a discharge valve (64) to direct some or all of the used solution (via line 66) from the recycling tank (60) to a waste water thickening tank (68).

Also sent to the waste water tank is the liquid from the drained the rinse and dewatering screen (38), which is collected (via line 68) in a another sump tank (70). This liquid will be very dilute (low $NH_4$+ concentration) if the coal is rinsed with a de-ionized water rinse. A pump (72) moves the liquid (via line 74) to a cyclone separator (76) to remove coal particles. The liquid is then directed (via line 78) to the waste water thickening tank (68).

The thickening tank (68) can receives a flocculation solution (via line 80) to agglomerate any particulate matter in the waste water. A flocculation agent is mixed (via line 82 with clean process water (via line 84) in mixing tank (86), from which it can be supplied when need (via line 80) to the waste water thickening tank. The small particles cluster into larger agglomerates and settle to the bottom, where they are removed as sludge by a pump (88) to a refuse container. The sludge will contain a concentration of sulfate that can be processed for fertilizer.

The clean water discharge from the thickening tank is passed through a liquid ammonia scrubber (90) to precipitate out the ammonia remaining in solution. The water can be filtered, de-ionized, and re-used as process water. The liquid ammonia can be mixed into the sulfate sludge as a fertilizer ingredient, A high temperature tube furnace and emission monitoring instrument (not shown) may be used on a sample of the processed coal to sense and record a chemical analysis of the combustion product of the coal. As an example, a 1200° C. tube furnace will burn a coal sample at a temperature just above the high range of a fluidized bed burner used to generate electrical power, but below the well below the threshold where nitrogen oxides form (at approximately 1400° C. A tube furnace of the type is available from SentroTech of Berea, Ohio. The combustion gas from the coal burned in tube furnace can be automatically analyzed by an emission monitoring instrument such as sold by VARIOplus Industrial. The monitoring instrument can detect trace amounts of $SO_2$, NOx $CO_2$ and other potential atmosphere pollutants. The instrument can be connected by RS 232 data transport cable to a computer to record the data. The data can be used for certification of the coal improvement for tax credits or quality control, and can have certain thresholds programmed to reject a coal batch that exceeds an emission threshold.

Alternative Plant Layouts.

The reaction vessel mixing and the gravity separation of dense particle functions that are done by the rotary drum scrubber may be serialized by having the reaction vessel merely mix the aqueous ammonia solution thoroughly into the coal to oxidize the organic sulfur and free the pyretic sulfur from adhering to the coal, without also clarifying the pyrite from the coal slurry inside the drum. In this alternative layout, the coal slurry would pass from the reaction vessel into a gravity separator to remove the pyrite and other dense materials.

As an alternative to a rotating drum mixer, the reaction vessel could be a screw or paddle mixer. For example, a dual auger screw washer of the type used to scrub dirt from crushed stone or sand can be modified for the purpose of being a reaction vessel in a continuous process. The angle and depth of the washing trough can be adjusted to provide sufficient depth of the aqueous ammonia solution, and the number and configuration of the meshing paddles can be selected to give adequate mixing and dwell time. The bulk coal will be carried out by the augers, while coal fines and dirty water will flow out over the back weir. Two or more screw washers can be used serially, with the high end discharge of one washer feeding directly into the bath of the next mixer. The dirty solution that is drained from the back weirs of the washers can be routed via a drain line into a sump and clarified for recoverable fine coal and reusable solution as described in the rotary drum layout. The process controller can regulated the amount of flow into the screw washers produce a continuous back flow over the weir, and can route fresh solution to the recycle supply as need to maintain the concentration range.

In all of the potential layouts, the ports of the reaction vessels, as well as some of the downstream machinery, may be covered by vacuum hoods to trap vapors released in the process.

Mobile Plant Layout.

Figure 2:
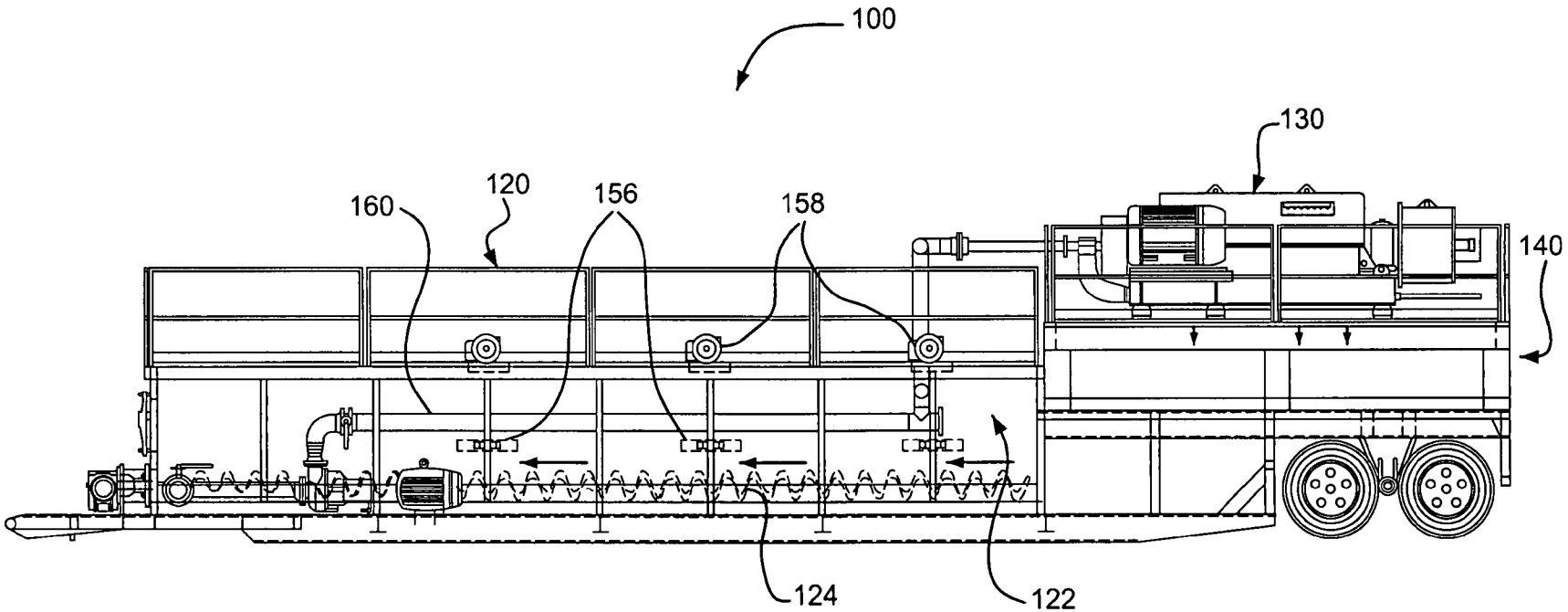
FIG. 2 is a side elevation view of a mobile coal refining plant.
Figure 3:
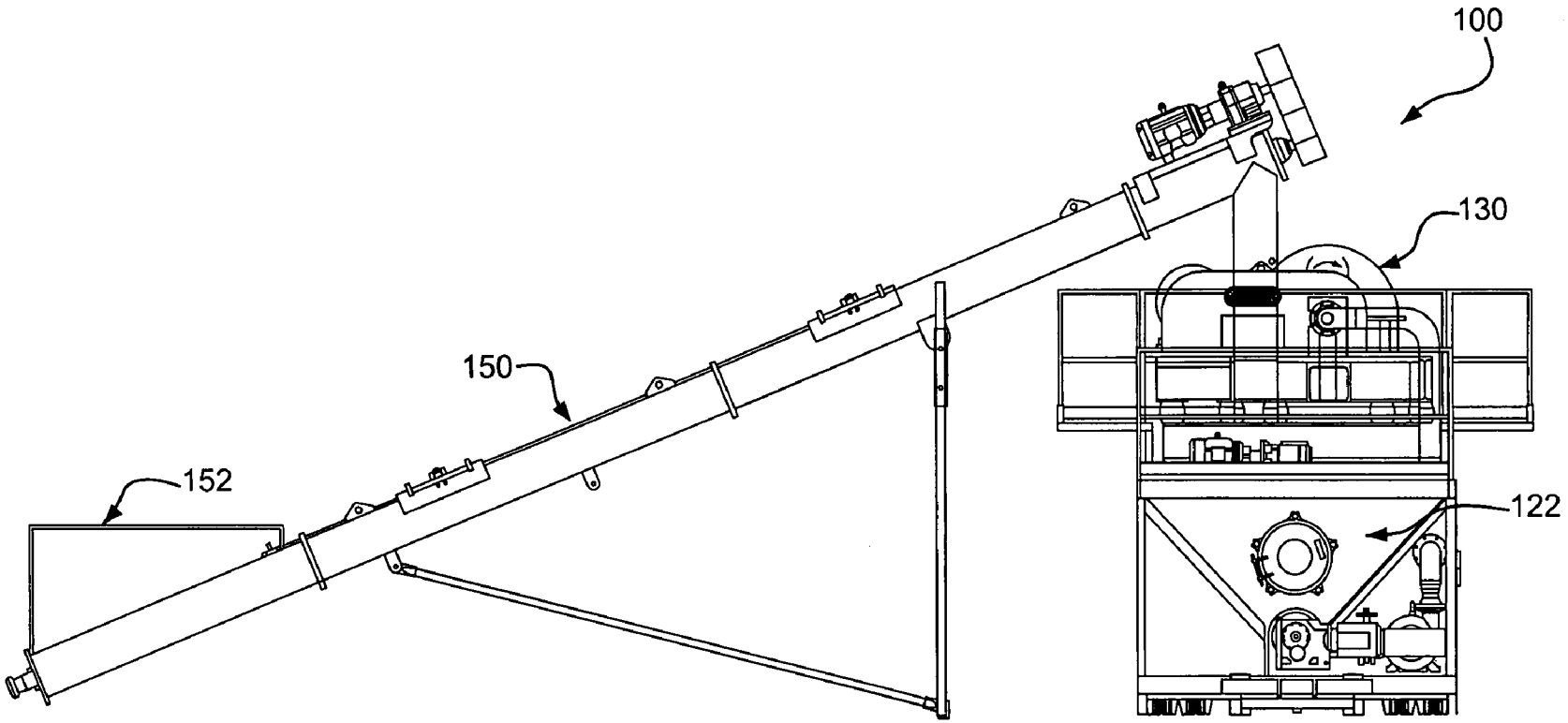
FIG. 3 is a front view of the mobile coal refining plant with a feed auger.

FIGS. 2 and 3 illustrate a mobile plant layout (100) in which the mixing/reaction vessel (120) and dense particle separator (130) are mounted on a wheeled trailer (140). A ammonia and water tanks, and supply and drain lines can be mounted on other vehicles and connected to the reaction vessel and the separator.

The mixing/reaction vessel (120) in this embodiment is a modified mixer and clarifier sold by DEL Tank and Filtration Systems under the trade name TOTAL CLEAN. It has a V-shaped mixing tank (122) with a shaft-less screw (124) at the bottom to move settled solids. This process is a continuous process in which the tank remains filed with ammonia water solution as the coal is processed through it.

The coal is introduced to the V-tank via a feed auger (150), as shown in FIG. 3. The hopper tank (152) of the auger can be used as a prewash station. As in the other layouts, if a prewash is used, the water in the prewash is preferably de-mineralized with a commercial water softener. Additional caustic soda may be added to the de-mineralized water to dissolve the sulfate coating and other soluble material from the surface of the coal.

The feed auger (150) drops the coal into the ammonia water filed V-tank. Mixing paddles (156) driven by mixing motors (158) are aligned along the tank. The paddles churn, lift and drop the coal in the solution. As the heavier particles settle to the bottom, they are moved by the screw toward the opposite end of the tank, where there is a pump and pickup port to a conduit (160) leading to the separator !30). The coal is picked up as a slurry that can be pumped to the separator.

As in the other embodiments, the dilution ratio for the solution in the V-tank is maintained in a preferred range of 3% to 5% ammonia to water. Aqueous ammonia from external connections such as a bubbling tank is routed to the V-tank to replace solution taken out with the slurry and not entirely replaced with return flow of recycled and partly depleted aqueous ammonia from the separator. As in the first embodiment, sensors, metering pump and valves controlled through the process controller can be used to control the discharge of weak solution and the addition of fresh ammonia to maintain the concentration range. When $NH_4$ concentration drops below a target range (i.e., below 3%) or the volume of solution becomes low, the controller supplies a metered volume of fresh solution to bring the total solution to the desired range.

The separator (130) in this embodiment is a screen bowl centrifuge such as sold by Decanter Machine Inc. The first stages of the centrifuge extract the major portion of the ammonia solution as effluent. This effluent is routed back to the V-tank, preferably via a sump where the concentration of $NH_4$+ in the solution may be measured and signaled to the process controller, which controls the flow of both return effluent and fresh solution into the V-tank.

The latter stages of the screen bowl separator have rinse nozzles and a screen separator. A fresh water rinse can be applied and drained off a this stage. The coal emerging from the centrifuge is damp, but essentially packed solids. A press or other drier can be used to extract further moisture if desired.

I claim:

1. A method of processing coal to remove contaminants, comprising the steps of:

providing a solution of aqueous ammonia in a selected concentration range of ammonia in a reaction vessel;

adding coal into the reaction vessel;

agitating the coal inside the reaction vessel to mix the coal and solution to cause the solution to be brought into contact with the surfaces and pores of the coal;

discharging the processed coal from the vessel;

monitoring the process to detect when the concentration of aqueous ammonia in the reaction vessel has fallen below the selected range; and feeding aqueous ammonia solution with an ammonia concentration in or above the selected range to the reaction vessel to return the solution to within the selected range.

2. A method as in claim 1, wherein the selected range is 3% to 5% ammonia.

3. A method as in claim 1, further comprising the steps of:

draining dirty solution containing coal fines from the reaction vessel;

recovering coal fines from the dirty solution, and recycling the solution to the reaction vessel;

wherein the step of monitoring to detect when the ammonia concentration has fallen below the selected range is done by monitoring ammonia concentration in the drained solution either before or after recovering coal fines.

4. A method as in claim 3, wherein the recovered coal fines are mixed back into the processed coal.

5. A method as in claim 4, comprising the further steps of:

rinsing the processed coal and recovered fines with de-ionized water; and dewatering the rinsed coal.

6. A method as in claim 5; comprising the further steps of collecting effluent from the dewatering step and processing the effluent to separate fine coal from the effluent.

7. A method as in claim 1, further comprising the step of separating pyritic sulfur and other denser than coal particles from the coal by gravitational or centrifugal screen separation apparatus within the reaction vessel.

8. A method as in claim 1, wherein the step of removing the processed coal from the reaction vessel includes the steps of removing the coal in a slurry of coal in aqueous ammonia solution, directing the slurry to gravitational or centrifugal screen separation apparatus outside of the reaction vessel to separate pyritic sulfur and other denser than coal particles from the slurry, and draining the slurry to separate the coal the solution.

9. A method as in claim 8, further comprising the step of recycling the solution drained from the slurry back to the reaction vessel, and wherein the step of monitoring to detect when the ammonia concentration has fallen below the selected range is done by monitoring ammonia concentration in the solution drained from the slurry.

* * * * *